United States Patent [19]

Bucheister

[11] 4,039,991

[45] Aug. 2, 1977

[54] THERMOSTATIC SWITCH WITH RESET MECHANISM

[75] Inventor: Henry C. Bucheister, Cranston, R.I.

[73] Assignee: Elmwood Sensors, Inc., Cranston, R.I.

[21] Appl. No.: 642,062

[22] Filed: Dec. 18, 1975

[51] Int. Cl.[2] ..... H01H 37/70; H01H 37/74

[52] U.S. Cl. ..... 337/348; 337/358

[58] Field of Search ..... 337/348, 349, 356, 358, 337/367, 56, 91, 354

[56] References Cited

U.S. PATENT DOCUMENTS

| | | | |
|---|---|---|---|
| 3,081,388 | 3/1963 | Cox | 337/349 |
| 3,500,278 | 3/1970 | Them | 337/367 |

*Primary Examiner*—Harold Broome

*Attorney, Agent, or Firm*—Frank A. Steinhilper; Alfred H. Rosen

[57] ABSTRACT

A trip free miniature thermostatic switch having a bimetallic disc located therein is responsive to temperature for localized control of an electrical circuit. A reset mechanism in said switch provides for closing of the circuit therein, but only after the temperature has returned the bimetallic disc to the switch closed position. For example, a bimetallic member may move a switch component to the open position where it is releasably retained until the temperature change has reversed and the release mechanism is positively operated.

7 Claims, 7 Drawing Figures

THERMOSTATIC SWITCH WITH RESET MECHANISM

BACKGROUND OF THE INVENTION

The present invention relates to a thermostatic switch that may be utilized in electrical appliances, copying machines, computers and many other electrically operated devices and machines. The present switch includes provision for reset mechanism for reestablishing electrical communication therein.

Reset devices for thermostatic switches have been utilized heretofore and have normally included a manually operable plunger that was engageable with an actuating member that was, in turn, engageable with a bimetallic disc. Thus, in the prior known devices resetting of the circuit in the switch was accomplished by depressing a reset element to move the actuating member directly into engagement with the bimetallic disc, wherein the bimetallic disc was urged to the switch-closed position.

Although the prior known thermostatic switches which included a manual reset control performed the function of resetting the movable contact member to the closed position thereof, it was not always desirable to return the movable contact member to the closed position and establish electrical communication through the switch, until the bimetallic disc in response to the changing environmental temperature had returned to the original or switch closed condition. Thus, often times the movable contact member in the prior known thermostatic switches was prematurely returned to the closed position thereof, and this in some instances resulted in malfunction of the device or other temperature-related hazard. In many such cases it is desired to open or close an electric circuit and retain it in such condition until after human intervention or investigation. It is then desired to return the circuit to its original condition, but only after the temperature has returned to a previous level.

In an apparent effort to avoid this problem, switches have been provided with sliding catch and release members. Such switches are generally larger than desired and may be unreliable in operation. Such a switch is shown in Cox U.S. Pat. No. 3,081,388.

SUMMARY OF THE INVENTION

According to the present invention a thermostatic switch has a manual reset mechanism that releasably holds a contact member out of engagement with a second contact member. This reset mechanism is brought into operation when a bimetallic member, usually a disc or like member opens the switch. The mechanism is released to return the switch to the closed position when the bimetallic disc returns to the normal switch closed position and when, in addition, the manual reset mechanism is operated.

The reset mechanism as embodied in the present invention includes a lock device that is engageable with a movable contact member in the switch-open position, the lock device in turn being engageable and releasable by a manual reset element. When the temperature reaches a predetermined or unsafe condition, the bimetallic disc as located in the switch of the present invention is operable to urge the movable contact member to the open position thereof, wherein a latch finger of the lock device engages the movable contact member for retaining it in the open position. After the temperature changes to a predetermined point, the bimetallic disc returns to the switch closed position, whereafter the reset mechanism is manually operable to release the latch finger from engagement with the movable contact member thereby allowing the movable contact member to return to the closed position thereof. Usually, but not necessarily, the switch is sensed to open when the temperature gets too hot and to be reclosed after the temperature decreases. Thus, if a heating device gets too hot the switch can turn it off. Similarly, the switch can be made in opposite sense and would be appropriate for example, to turn off a cooling device which has become too cold.

It is an object of the present invention to provide a reset mechanism for a thermostatic switch, wherein a movable member in the switch is returned to the closed position thereof by the reset mechanism, only after the bimetallic disc in the switch has flexed to the switch-closed position.

Another object is to provide a reset mechanism for a thermostatic switch that includes a pivotally mounted locking device that is engageable with a movable contact member in the switch when the contact member is moved to the open position thereof by a bimetallic disc, the movable contact member being retained in the open position by the bimetallic disc, and being released for return to the closed position by the reset mechanism, only after the bimetallic disc has returned to the switch closed position due to a change in temperature.

A further object is to provide a reset mechanism that is free from mechanical linkage with the temperature-sensing member or bimetallic disc, and which operates with extremely low frictional resistance.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
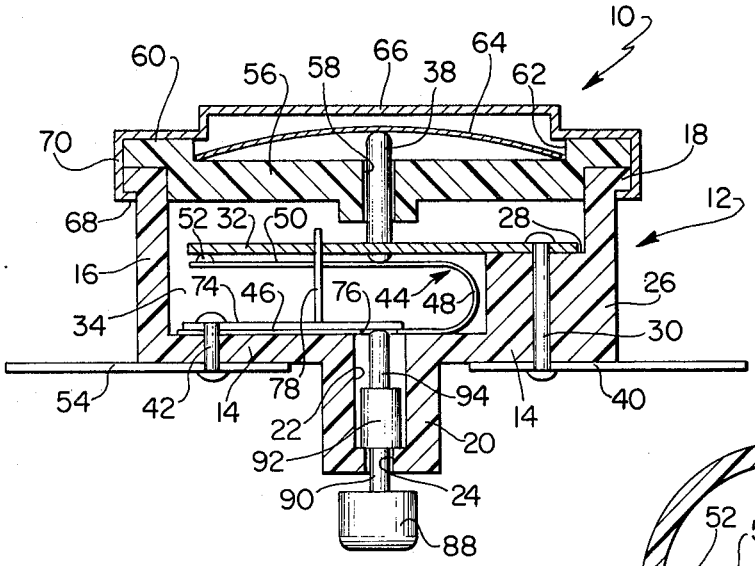
FIG. 1 is a sectional view of the thermostatic switch according to embodiment of the present invention showing the movable contact member in the switch in the closed position thereof.
Figure 5:
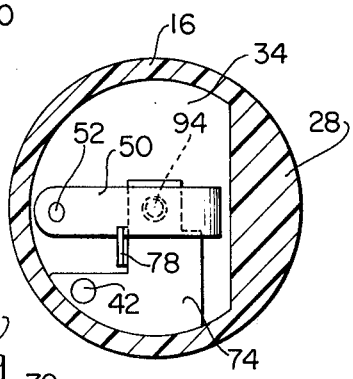
FIG. 5 is a sectional view taken along line 5—5 in FIG. 2.
Figure 2:
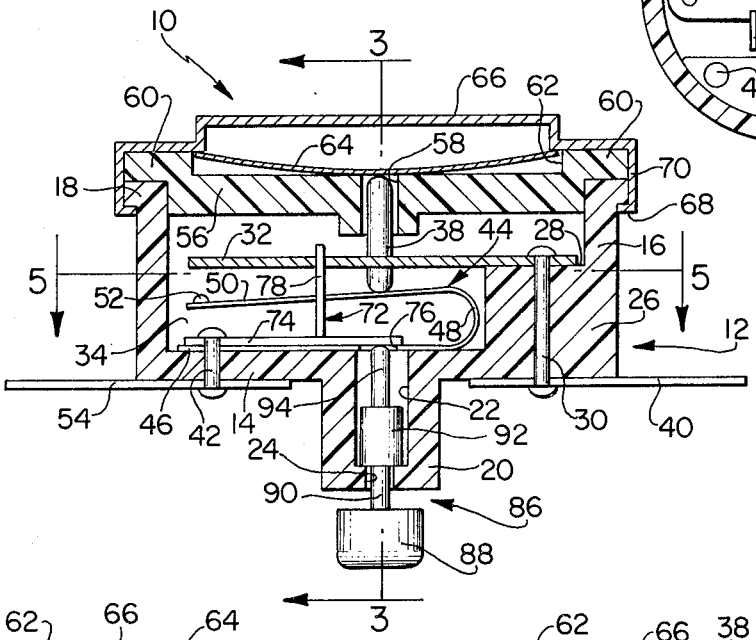
FIG. 2 is a view similar to FIG. 1 and showing the movable contact member in the open position after the bimetallic disc in the switch has been flexed due to an increase in temperature.

Refering now to the drawing and particularly to FIGS. 1 and 2, the thermostatic switch embodied herein is illustrated and is generally indicated at 10. As shown, the thermostatic switch 10 is of the type that includes a bimetallic element therein and is normally utilized in an application wherein control responsive to the environment or localized control is required. For example, many electrical appliances and machines are intended to be interrupted in operation when a predetermined temperature is reached, as in the case of cooking units, coffee percolators, and the like, or when a dangerous condition is reached, as in the case of electrical machines subject to dangerous overheating. Likewise, an environment may itself overheat: a thermo-responsive fire alarm responds to a dangerous heat level and requires an automatic signal device.

As illustrated in FIGS. 1 and 2, the thermostatic switch 10 includes a housing generally indicated at 12 that is defined by a base 14 to which an annular wall 16 is integrally joined, the uppermost end of the annular wall terminating in an annular flange 18. The housing 12 is preferably molded of a suitable plastic material such as an insulating or dielectric material of the sort conventionally used in switch manufacture. Molded as an integral part of the base 14 is a downwardly extending central projection 20 which communicates with the bore 22, the purpose of which will be described hereinafter.

Offset with respect to the axis of the housing 12 and formed as an integral part of the base 14 and annular wall 16 is a thickened arcuate portion 26, the uppermost edge of which forms a shelf 28 with the adjacent portion of the annular wall 16. Secured to the shelf 28 by a rivet 30 is fixed contact member 32, the contact member 32 projecting substantially the diameter of a cavity 34 as formed within the housing 12 and defined by the base 14 and annular wall 16. Fixed to the rivet 30 and located exteriorly of the housing beneath the base 14 is a terminal 40 that is disposed in electrical communication with an electrical lead.

Secured in the cavity 34 of the housing 12 by a rivet 42 is a contact member generally indicated at 44. The contact member 44 has a generally U-shaped configuration defined by a fixed leg 46, a flexed portion 48 and a second movable leg or contact arm 50 that is generally parallel to the leg 46 and that has a contact button 52 mounted on the outermost end thereof. The leg 46 is fixed to the interior wall of the base 14 by the rivet 42, thereby locating the contact arm 50 in floating relation within the cavity 34, the arm 50 being tensioned for engagement of the contact button 52 with the underside of the fixed contact 32. It is seen that the contact member 44 is located such that the arm 50 is disposed in a normally closed contact position for establishing electrical communication between the terminal 40 and a terminal 54 that is fixed to the exterior wall of the base 14 by the rivet 42.

Mounted on the uppermost end of the annular wall 16 of the housing 12 and defining the top of the cavity 34 is a guide member 56 that is also molded of suitable material, usually the same material as housing 12, that has a central opening 58 formed therein. The guide member 56 is formed with an annular peripheral flange 60 that is received on the annular flange 18 of the housing 12; if desired guide member 56 may itself have a shoulder to engage housing 12. Formed in the upper portion of the guide member 56 is a circular recess 62 in which a bimetallic disc 64 is received. The bimetallic disc 64 is captured in the recess 62 by a cap 66 that is secured to the housing 12 by an inturned lip 68 formed on the underside of an annular wall 70 of the cap. As seen in FIGS. 1 and 2, the lip 68 engages the underside of the annular flange 18 of the housing 12 and secures the cap 66 in place for capturing the disc 64 in the recess 62.

The bimetallic disc 64 is flexed in the conventional manner in response to temperature changes of the environment surrounding the switch 10, and is movable in the recess 62 to disengage the contact arm 50 of the contact member 44 from electrical contact with the fixed contact 32 by means of pin 38. For the purpose, the pin 38 which engages the disc 64 extends through the central opening 58 formed in the guide member 56 and passes beside contact member 32 for engagement with the contact arm 50. Thus, when the bimetallic disc 64 flexes from the position illustrated in FIG. 1 to the position illustrated in FIG. 2, the actuating pin 38 is urged downwardly, thereby forcing the contact 50 of the contact 44 to the open position. Electrical communication between the terminals 40 and 54 is then interrupted.

Figure 3:
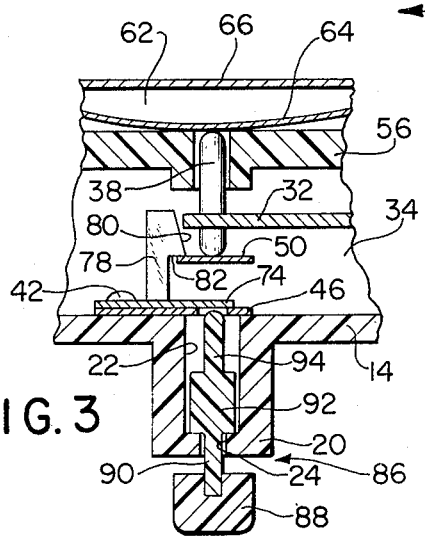
FIG. 3 is a sectional view taken along line 3—3 in FIG. 2.
Figure 4:
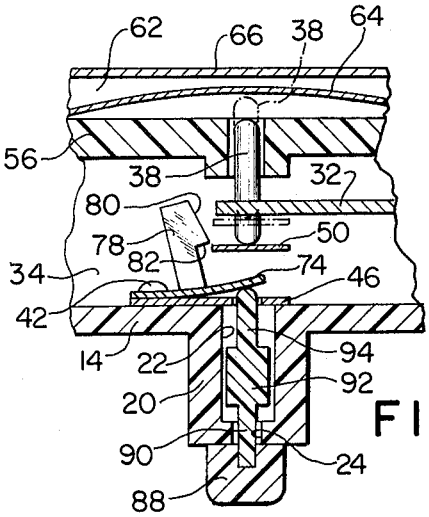
FIG. 4 is a view similar to FIG. 3 and showing the location of the reset element after it has been depressed to disengage the movable contact member from the locked position.

The thermostatic switch as embodied in the present invention provides for the manual resetting of the contact member 44 from the open position illustrated in FIG. 2 to the closed position illustrated in FIG. 1. However, the resetting of the contact member 44 can only occur after the bimetallic disc 64 has returned to the switch-closed position thereof as illustrated in FIG. 1. In order to accomplish this purpose, a locking device generally indicated at 72 is provided and includes a spring lever 74 that overlies the fixed leg 46 of the contact member 44 and is secured in position, for example, by the rivet 42 or other means. The outer end of the spring lever 74 overlies the fixed leg 46 of the contact member 44 and is secured in position by the rivet 42. The outer end of the spring lever 74 also overlies an opening 76 formed in the fixed leg 46 of the contact member 44, the opening 76 communicating with the bore 22 formed in the projection 20. Fixed to the spring lever 74 and projecting upwardly therefrom is a latch finger 78, which as illustrated in FIGS. 3 and 4, has an inclined surface 80 formed thereon under which a notch 82 is defined. The notch 82 is located so as to engage the contact arm 50 of the contact member 44 for retaining the arm 50 in the open position thereof as illustrated in FIGS. 2 and 3, when the disc 64 is flexed in response to a change, and usually to an increase in temperature. Most frequently the switch senses a changing temperature as heat passes through cap 66, thus heating disc 64. During a resetting operation, the spring lever 74 is pivotally moved to release the latch finger 78 from locking engagement with the movable leg 50 of the contact member 44. In order to pivotally move the spring lever 74, a reset device generally indicated at 86 is provided and includes a stem 90 to which a head 88 is joined. An interior guide 92 is integrally molded to stem 90 and is received in sliding relation within the bore 22 as formed in the central projection 20. The lowermost end of the stem 90 extends through the opening 24 of the projection 20, the head 88 being located exteriorly of the projection for manual depression as required. The guide 92 also defines a stop for the reset device 86 when it is released after the depression thereof. As shown in FIGS. 3 and 4, a stem 94 is formed integrally with the guide 92 and extends upwardly therefrom, projecting through the opening 76 as formed in the fixed leg 46 of the contact member 44 for engagement with the underside of the spring lever 74.

If desired the reset device 86 may be separate from the switch. For example, an operator may have a reset device in his possession so that unauthorized reset is prevented or made less easy. In such case the reset device and bore 22 may be irregularly shaped or keyed to further inhibit unauthorized reset.

In operation, the contact button 52 of the contact arm 50 of the contact member 44 is normally located in engaging relation with the fixed contact member 32 and establishes electrical communication between the terminals 40 and 54. When the temperature changes, usually increasing to a point to cause the bimetallic disc 64 to flex from the position illustrated in FIG. 1 to that illustrated in FIG. 2, the disc 64 urges the actuating pin 38 downwardly to move the arm 50 of the contact member 44 out of engagement with the contact member 32 to the open position thereof, thereby interrupting the circuit in the switch. When the contact arm 50 of the contact member 44 is moved downwardly to the position illustrated in FIG. 2, it moves over the inclined edge 80 of the latch finger 78 until it snaps beneath the notch 82 for engagement therewith. The arm 50 is thus locked in the open position by the latch finger 78.

The construction and arrangement of the latch finger 78 as it engages the movable leg 50 of the contact member 44 prevents a manual override of the bimetallic disc 64 by the reset device. Thus, it is not possible by the present invention to override the bimetallic disc 64 when it is still in the switch-open position and to return the contact arm 50 to the normally closed position thereof by actuation of the reset device 86.

Assuming that the temperature has not decreased sufficiently to cause the disc to snap to the switch-closed position, depressing the reset device 86 by pushing upwardly on the head 88 will pivot the spring lever 74 for releasing the latch finger 78 from engagement with the arm 50, but the bimetallic disc 64 will not return to the position illustrated in FIG. 1. Only after the disc 64 has returned to its switch-closed position due to a decrease in temperature can the switch be reset so as to once again establish electrical communication therethrough. In this event and after the bimetallic disc has flexed to the switch-closed position illustrated in FIG. 4, the reset device can be actuated by depressing the head 88, which causes spring lever 74 to flex, pivoting latch finger 78 attached thereto. As illustrated in FIG. 4, release of the latch finger 78 from engagement with arm 50 of the contact member 44 enables the normal spring tension in the movable arm 50 to return it to the normally closed position illustrated in FIG. 1. In this position the contact button 52 once again engages the fixed contact 32, thereby establishing electrical communication in the switch and between terminals 40 and 54.

Figure 7:
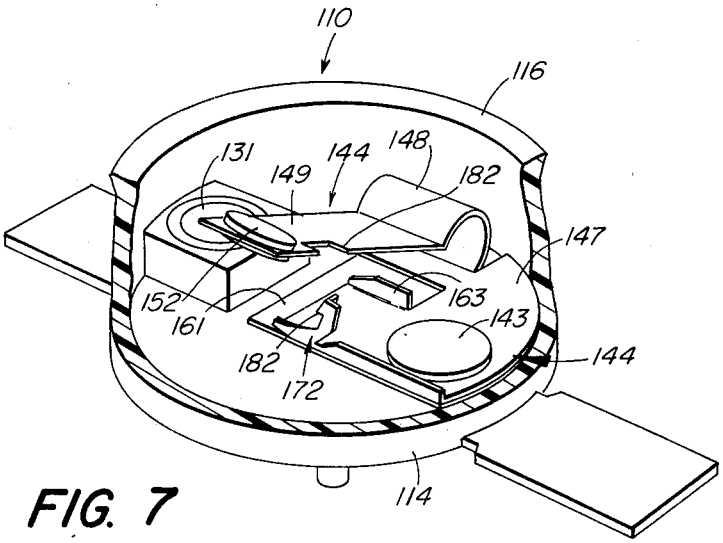
FIG. 7 is a perspective view, partially sectioned, of a portion of the switch of FIG. 6.
Figure 6:
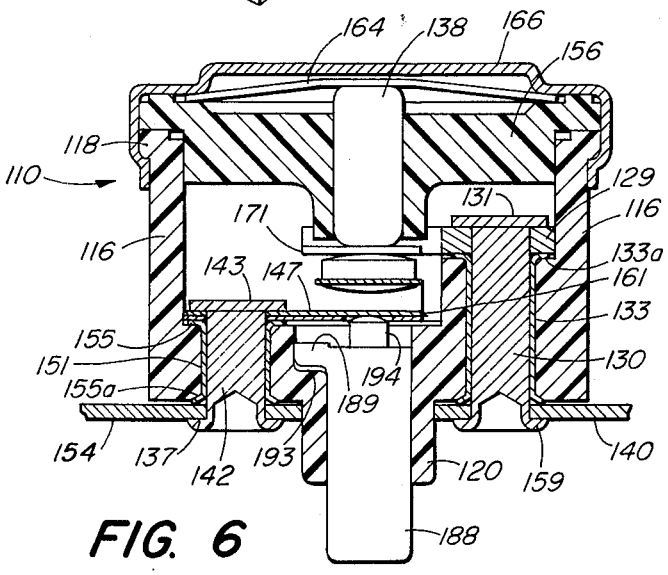
FIG. 6 is a section view of a thermostatic switch according to another embodiment of the invention.

In FIGS. 6 and 7 is illustrated another embodiment of the invention. In these figures is illustrated a thermostatic switch generally designated 110 including a housing defined by a base 114 to which annular wall 116 is joined. An annular flange 118 may be positioned at the uppermost end of the annular wall. The housing ordinarily is a suitable molded material, as with the switch of FIG. 1. Mounted at the top of wall 116 is a guide member 156 having a central opening receiving an actuating pin 138. A bi-metallic disc 164 is positioned above the guide member 156 and is secured in position by means of a cap 166 fastened onto the case and secured around flange 118.

Formed in the bottom of the thermostatic switch and integrally with base 114 is a central projection or guide 120 receiving a release or reset pin 188. At the inward end of pin 188 is formed a stop 189 co-acting with a shoulder 193 to limit the outward motion of pin 188.

Mounted on the base 114, as can best be seen in FIG. 7, is a contact and release assembly generally designated 144. This assembly 144 may desirably be a single unitary metal element stamped and shaped to the desired form as illustrated in FIG. 7. A contact arm 149 bearing at its end a contact button 152 is joined to the base plate 147 by a curve bight portion 148. The base plate 147 is fastened to base 114 of the casing by suitable means such as for example, a rivet 142 having a head 143. A sleeve 151 is fixed in base 114 and an inward flange 155 on the sleeve 151 co-acts with rivet head 143 to secure base plate 147 securely to base 114. At the opposite end an external annular flange 137 extending outwardly from casing secures a contact member 154 and holds it in position between flange 137 and a lower flange 155A on sleeve 151. Base plate 147 and contact 154 are thus securd in fixed relationship to each other by means of an all metal contact assembly including rivet 142 and sleeve 151. A projection 194 on pin 188 is positioned to press against base plate 147 near its inward or free edge 161 and when pin 188 is depressed causes base plate 147 to flex upwardly. At one side of base plate 147 adjacent its inward edge 161 is a locking device or latch member 172 and at an opposing edge of base plate 147 is a wall 163. The latch member 172 includes a latch finger 178 and a notch member 182 thereon. Contact arm 149 and latch finger 178 are so positioned relative to each other that when contact arm 149 is flexed downwardly it engages notch member 182 and is releasably secured thereby.

At a location removed from the position of rivet 142 a second rivet 130 is similarly mounted in base 114 with a second sleeve 133 co-acting with rivet 130 and its head 131 to secure a second contact member 129 within the housing and holding it firmly between rivet head 131 and sleeve 133 by gripping the contact member 129 between the rivet head 131 and sleeve 133 by gripping the contact member 129 between the rivet head 131 and a flange 133A on the sleeve 133. Externally a second external contact 140 is secured between rivet 130 and sleeve 133 by means of an external flange 159 on rivet 130. Thus contact 140 and contact 129 are fixed together in an all-metal contact formed by rivet 130 and sleeve 133. An internally extending contact arm 171 forming a part of contact member 129 is positioned to receive contact button 152 on the end of contact arm 149 whenever arm 149 is free from latch member 172. In the normal position, contact arm 149 is sprung to bring its contact 152 into electrical contact with contact member 129.

The element not described in connection with FIGS. 6 and 7 are similar to those of FIGS. 1 and 2, and perform similar functions.

In use and operation, switch 110 is connected into an electric circuit by means of external contacts 140 and 154 and positioned at a desired location where it can appropriately sense temperature external to the switch. At a predetermined temperature bimetallic disc 164 snaps between the outward position illustrated in FIG. 6 and an inward position such as for example, a position resembling that shown in FIG. 2 in connection with the first embodiment of the invention. When disc 164 snaps inwardly pin 138 presses against contact arm 149 and depresses contact arm causing it to be secured by flange finger 178. The contact arm 149 is held in this depressed position until released. When the temperature passes in reverse direction through a predetermined temperature bimetallic 164 snaps upward to the position shown in FIG. 6 releasing pin 138. Thereafter release pin 188 may be depressed, flexing base plate 147 and bending latch finger 178 backwards and away from its normal position. This flexing thereby releases contact arm 149. If bimetallic disc 164 has flexed to its first position when release pin 188 is depressed then arm 149 is free to flex upwardly into contact with contact arm 171. If, however, bimetallic disc 164 is still snapped to its inward position, pin 138 continues to hold contact arm 149 in its depressed position. In such case arm 149 although released, does not spring upwardly. Accordingly if switch 110 is mounted and employed to break an electric circuit upon reaching an elevated temperature then the circuit is opened when the switch gets too hot and can not again be closed until both disc 164 has snapped to its original position and pin 188 is depressed.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A thermostatic switch, comprising a housing having a cavity formed therein, a temperature responsive bimetallic disc located in said housing and being responsive to a predetermined temperature for exerting a flexing action, a first contact member located in said cavity and being electrically interconnected to a first terminal external to said housing, a second contact member located in said cavity adjacent to said first contact membr and being electrically interconnected to a second terminal external to said housing, said second contact member being spring mounted and movable between a switch-closed position in which it makes electrical contact with said first contact member and a switch open position, spaced from said first contact member and normally spring biased toward the switch-closed position, a first actuating member located in said housing and being responsive to flexing movement of said disc for moving said second contact member from said switch-closed position to said switch open position, locking means for locking said second contact member in the switch open position said locking means being releasable from engagement with said second contact member, wherein said second contact member is free to return to the normally closed position by spring action thereof, when both the locking means is released and said actuating member is in the switch-closed position, said locking means mounted on a flexible support normally positioned in a locking position, and a release actuating member engageable with said locking member and operable externally of said housing to flex said flexible support member to the release position, said release actuating member not independently operable to move said second contact member into its switch closed position.

2. A thermostatic switch as claimed in claim 1, said locking means including a latch finger located in said cavity and that is pivotally movable out of engagement with said second contact member, by said release actuating member.

3. A thermostatic switch as claimed in claim 1, said second contact member comprises a spring arm member normally mounted in said switch-closed position and flexibly movable to said switch open position.

4. A thermostatic switch as claimed in claim 1, said release actuating member including an axially movable plunger, the innermost end of which extends into said cavity for engagement with said flexible support and the outermost end of which projects outwardly of said housing for manual depression thereof for releasing said locking means from engagement with said second contact member.

5. A thermostatic switch as claimed in claim 1, said actuating member including a pin located centrally of said housing and one end of which axially engages said bimetallic disc, the other end of said actuating member engaging said second contact member, wherein flexing movement of said disc moves said pin in a longitudinal direction to urge said second contact member out of engagement with said first contact member and into locking engagement with said latch finger.

6. A thermostatic switch as claimed in claim 5, said second contact member being formed of a spring material that is operable to return the movable contact member to the closed position only when the disc returns to the closed circuit position thereof, wherein said spring element is pivoted to release the latch finger from engagement with said movable contact member.

7. A thermostatic switch as claimed in claim 1, wherein said bimetallic disc is mounted to move the second contact member to the switch open position at a temperature at least as high as said predetermined temperatures.

* * * * *